US005218574A

United States Patent [19]

Peregrim

[11] Patent Number: 5,218,574

[45] Date of Patent: Jun. 8, 1993

[54] ELECTRICAL FIRING CIRCUIT

[75] Inventor: Frank Peregrim, Silver Spring, Md.

[73] Assignee: The United States of America as represented by the Secretary of the Navy, Washington, D.C.

[21] Appl. No.: 80,178

[22] Filed: Oct. 12, 1970

[51] Int. Cl.[5] ..... F42C 13/00

[52] U.S. Cl. ..... 367/136; 102/424

[58] Field of Search ..... 317/80; 102/70.2 R, 102/424, 427; 367/136, 135, 96

[56] References Cited

U.S. PATENT DOCUMENTS 3,225,695 12/1965 Kapp et al. ..... 102/220
3,312,869 4/1967 Werner ..... 102/217
3,417,306 12/1968 Knak ..... 363/21
3,424,924 1/1969 Leisinger et al. ..... 102/217
3,439,616 4/1969 Godsey et al. ..... 102/220
3,466,502 9/1969 Pinckgers ..... 313/238
4,470,419 9/1969 Sitler et al. ..... 102/263

*Primary Examiner*—Daniel T. Pihulic
*Attorney, Agent, or Firm*—Kenneth E. Walden

[57] ABSTRACT

A firing circuit for use in booby traps providing four different operational modes. A capacitor stores energy which is discharged through an electrical detonator upon the activation of a silicon controlled rectifier. The silicon controlled rectifier is activated by transistor circuitry in the event of supply voltage depletion or the physical parting of a break-wire by a target. It is also activated by a delay-timer for timed self-destruction and by circuitry responsive to vibrations in the firing circuit generated by the target.

8 Claims, 1 Drawing Sheet

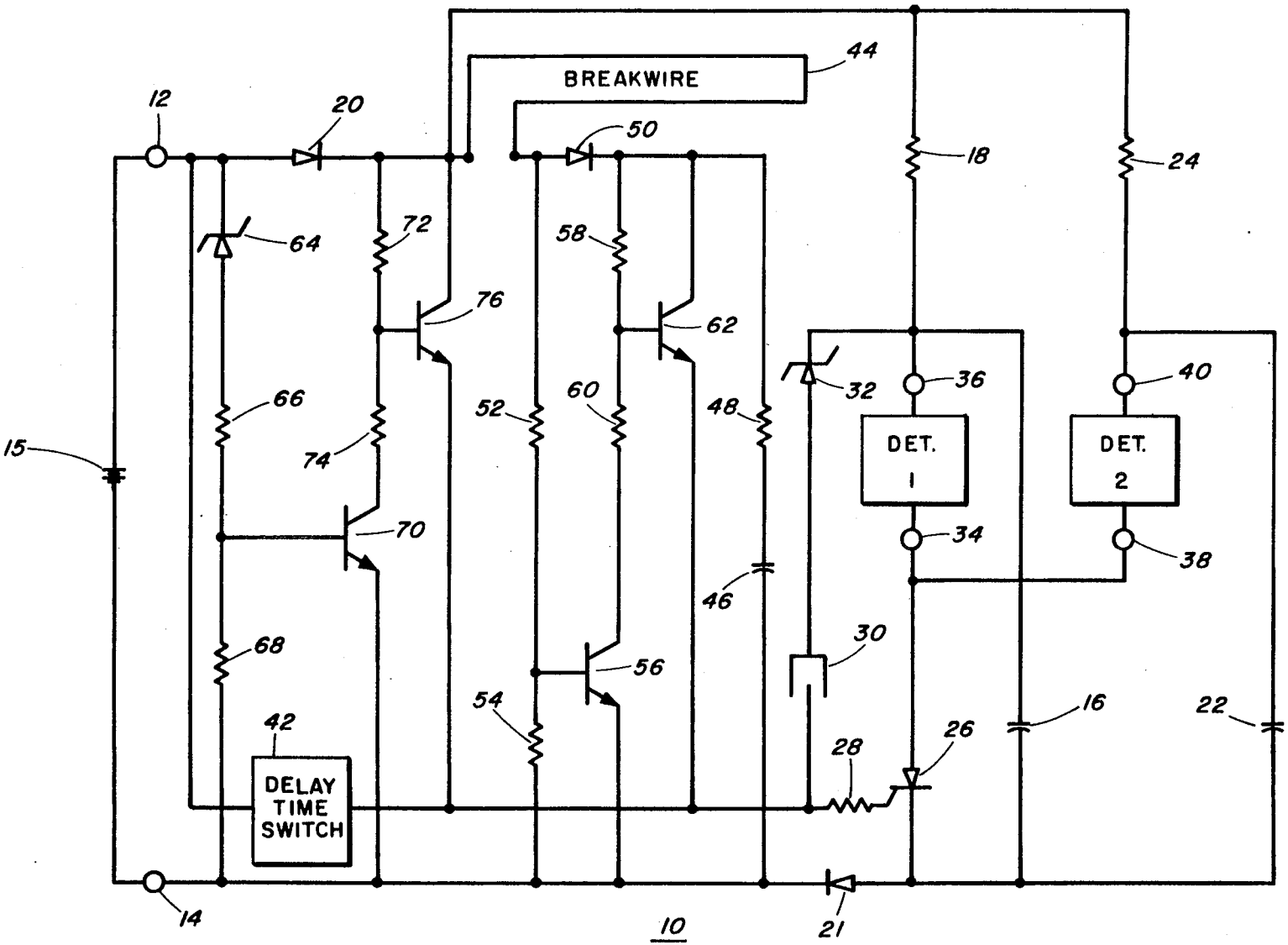
DET. 2
DET. 1
BREAKWIRE
DELAY TIME SWITCH
10
12
14
15
16
18
20
21
22
24
26
28
30
32
34
36
38
40
42
44
46
48
50
52
54
56
58
60
62
64
66
68
70
72
74
76

ELECTRICAL FIRING CIRCUIT

BACKGROUND OF THE INVENTION

This invention relates generally to electrical initiating circuitry, and more particularly to a low energy, multiple mode ordnance firing circuit.

Land mines and other booby traps rely in many applications upon electrical firing circuits for their detonation. In firing circuits for such military ordnance applications it is often desirable to have several alternative operational modes. Thus, for example, it may be desirable to have a provision for automatic self-destruction of the ordnance device after a certain period of time. Also, it may be desirable to have detonation initiated either by physical contact with a target or by vibrations generated by a target vehecle. Such multiple operational modes are not satisfactorily provided by present day firing circuits.

In addition to a lack of versatility, prior art firing circuits also require relatively large amounts of current which restrict their usefulness. Often, a particular military application places limitations on the physical size of the firing circuit. As a result, the small number of high energy sources, such as batteries, allowed to be used by the size limitations are incapable of supplying the required currents at ambient temperatures below freezing or over long operational time periods. Furthermore, existing firing circuits operate unsatisfactorily if the power supply is suddenly removed or its output power gradually depleted.

Additionally, in some military applications, it may be desirable to externally connect and control a remote detonator circuit of similar ordnance devices. Such optional features have been unavailable in prior art firing circuits.

BRIEF DESCRIPTION OF THE DRAWING

The drawing illustrates a firing circuit with four modes of operation.

SUMMARY OF THE INVENTION

Accordingly, one object of this invention is to provide a new and improved multiple mode electrical actuation circuit.

Another object of the invention is the provision of a new and improved firing circuit having ultra-low operational energy requirements.

Still another object of the present invention is to provide a firing circuit capable of firing upon power supply depletion.

A further object of the instant invention is to provide a firing circuit capable of firing a remotely located detonator.

A still further object of this invention is the provision of a firing circuit capable of operating at low temperatures.

Briefly, in accordance with one embodiment of this invention, these and other objects are attained by providing a firing circuit having a detonator ignition circuit energizable either upon actuation of a vibration responsive circuit element or the severance of a circuit element or the operation of a timed circuit element or the discharge of stored energy in a circuit element upon depletion of the energy source.

A more complete appreciation of the invention and many of the attendant advantages thereof will be readily appreciated as the same becomes better understood by reference to the following detailed description when considered in connection with the accompanying drawing wherein the sole figure is a schematic diagram of the electrical firing circuit of the present invention.

DESCRIPTION OF THE PREFERRED EMBODIMENT

Referring now to the drawing, the electrical firing circuit 10 of the present invention is shown as being connected at terminals 12 and 14 to an external source of unidirectional potential 15, such as a battery, wherein the positive side is connected to terminal 12, and the negative side is connected to terminal 14 which terminal provides a common reference potential in the firing circuit.

The electrical firing circuit 10 has four different modes of operation, the first of which to be considered is the anti-disturbance mode. When the firing circuit is connected to the external source of potential 15, an energy storage device 16, such as a capacitor, charges through a resistor 18, a diode 20, and a diode 21 connected serially therewith across supply terminals 12 and 14, so that the supply voltage appears across capacitor 16 upon completion of charging. Optionally, an additional energy storage device 22, such as a capacitor, may be connected in series with a resistor 24 and diodes 20 and 21 to also charge to the supply voltage. It will be noted that the series combination of resistor 24 and capacitor 22 is connected in parallel with the series combination of resistor 18 and capacitor 16.

Capacitor 16 is connected in series to the gate of a gated switch 26, such as a silicon controlled rectifier (SCR), through a resistor 28, a conventional vibration sensitive circuit closure element 30, such as a tremble switch, and a zener diode 32. When the vibration sensitive switch 30 senses a physical vibration of preset magnitude, such as would be caused by a proximately moving vehicle, it momentarily closes, causing a small amount of the positive charge from capacitor 16 to pass through zener diode 32 and resistor 28 to the gate of SCR 26. The cathode of SCR 26 is connected to a terminal 34 and capacitor 16 is connected to a terminal 36 across which a conventional electro-responsive detonator DET 1 is connected. Similarly, a pair of terminals 38 and 40 are connected between capacitor 22 and the cathode of SCR 26 to which a remotely located electro-responsive detonator DET 2 may be optionally connected for initiating a remotely located ordnance device. When SCR 26 receives the gating signal upon the closure of vibration responsive switch 30 and is thereby made conductive, capacitor 16 discharges through DET 1 and capacitor 22 discharges through remote DET 2, initiating both associated explosives. A defect in DET 2, such as a short circuit or accidental break in the firing leads will not effect the initiation of DET 1, even though the discharging of capacitors 16 and 22 is accomplished through the same SCR. It should be evident that when vibration sensitive switch 30 is in its normally interrupted or open stage, the afore-described circuitry draws no current from power supply 15, thereby reducing the energy requirements of the firing circuit 10.

It should be noted that zener diode 32 prevents firing by closure of vibration sensitive switch 30 before capacitors 16 and 22 have been completely charged. When the voltage across the zener diode is less than its breakdown voltage no current flows into the gate of SCR 26 whose triggering is dependent upon the gate current exceeding a threshold value. Thus, if zener breakdown voltage has not been reached, closure of vibration sensitive switch 30 will not trigger the SCR. When capacitors 16 and 22 are fully charged, however, zener breakdown occurs and a triggering current is available to the gate of SCR 26.

In the second mode of operation, a delay time circuit closure element 42, such as a conventional electrolytic delay timer switch, is connected between terminal 12 and resistor 28. After a preset delay time, which may, for example, equal the maximum time that it is desired to have the associated land mine or other booby trap operational, switch 42 automatically closes, thereby generating a gating signal in SCR 26 by directly connecting the power supply to the gate of SCR 26 through resistor 28. Again, capacitor 16 will discharge through DET 1, and capacitor 22 will discharge through remotely located DET 2 effecting ignition thereof. It will be evident that since delay time switch 42 is normally open no current is drawn from the power supply by the detonating circuitry, as in the anti-disturbance mode.

The third operational mode depends upon the parting of a conventional breakwire 44, which is a very fine electrical conductor reeled out from the firing circuit. The breakwire is limited in length only by the cumulative voltage drop that occurs at long distances, such as over 1000 feet. Upon the application of the supply voltage at terminals 12 and 14, a capacitor 46 is charged through a resistor 48, diode 50, breakwire 44, and diode 20, serially connected across supply terminals 12 and 14. At the same time, resistors 52 and 54, which form a voltage divider network connected at their common junction to the base of a transistor 56, bias it into conduction. Resistors 58 and 60 also form a voltage divider network and are connected at their common junction to the base of a transistor 62. With transistor 56 turned on, these resistors draw current and are of appropriate values to bias transistor 62 off. As long as transistor 62 remains off, SCR 26 will receive no current from charged capacitor 46. When breakwire 44 is parted, as by contact with a moving target, the supply voltage is removed from this portion of the circuitry. The energy from charged capacitor 46 is prevented from reaching the bias network of resistors 52 and 54 by diode 50. Thus, with no forward biasing potential available, transistor 56 is turned off, and a part of the energy stored in capacitor 46 is then directed to the base of transistor 62 rendering it conductive. With transistor 62 turned on, a gating signal will be applied to SCR 26, as the charge on capacitor 46 is applied to the gate thereof through transistor 62, resistors 48 and 28, causing SCR 26 to conduct. As in the previous two operative modes, capacitor 16 then discharges through detonator DET 1, and, optionally, capacitor 22 discharges through detonator DET 2 to effect their ignition. Since resistors 52, 54, 58 and 60 in this mode normally draw current with breakwire 44 intact they are of a large magnitude to limit the amount of current drain to a small value. For example, resistors 52 and 58 may be one megohm, resistor 54 may be 270 kilohms, and resistor 60 may be 10 kilohms.

The fourth mode of operation depends upon the depletion of the supply voltage. When full supply voltage is applied across terminals 12 and 14 a zener diode 64, a resistor 66, and a resistor 68 serially connected across the supply terminals act as a voltage divider network to bias a transistor 70 on, whereupon resistors 72 and 74 which form a voltage divider network with their common junction connected to the base of a transistor 76 bias transistor 76 off. If the supply voltage fails or falls below a certain established level, zener diode 64 can no longer provide a constant voltage drop and, therefore, transistor 70 ceases to conduct. Thereupon a small amount of stored energy from capacitors 16 and 22 will pass through resistors 18 and 24, respectively, and then through resistor 72 to the base of transistor 76 rendering transistor 76 conductive. Diode 20 prevents the energy of capacitors 16 and 22 from reaching the biasing network of transistor 70. With transistor 76 turned on, a gating signal is applied to SCR 26 by the discharge of capacitors 16 and 22 through transistor 76 and resistor 28 to the gate of SCR 26. Thus, detonator DET 1 and detonator DET 2 will be ignited as in the three previously discussed operational modes. Since normally only transistor 70 is conducting, resistors 66, 68, 72 and 74 are chosen to be of a large enough magnitude to greatly limit the current drain from the battery supplies. Thus, resistors 66 and 72 may be one megohm, resistor 68 may be 270 kilohms, and resistor 74 may be 10 kilohms.

From the foregoing, it will be apparent that in the event of an accidental severance of the breakwire prior to arming the firing circuit of the instant invention is capable of satisfactory operation in either the first, second, or fourth modes described hereinabove. It is also apparent that this firing circuit has the capability of initiating a detonator at some remote place in addition to the detonator located in the vicinity of the circuit. In addition, it will be seen that the firing circuit requires minimal supply currents, thereby overcoming the problem of reduced supply capacity at low temperatures. Thus, commercially available batteries can be used without the need for special high energy batteries having low temperature capability.

Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. A multiple mode electrical initiating circuit comprising first terminal connectable to a undirectional energy source, second terminal connectable to a device to be initiated, a normally open gate, connected to said second terminal, first circuit connected to said first terminal and to said gate and including a first energy storage device normally chargeable by said connected energy source, vibration responsive means in said first circuit for effecting closure of said gate and initiation of said device by the discharge of said energy storage device, second circuit connected to said first terminal and to said gate for effecting closure of said gate by said energy source after a predetermined time period, third circuit connected to said first terminal and to said gate and including a second energy storage device normally chargeable by said connected energy source, said third circuit including circuit elements for normally interrupting the circuit path between said second energy storage device and said gate, severable current conductive means in said third circuit for effecting closure of said circuit path by said circuit elements upon being severed and closure of said gate by the discharge of said second energy storage device, and fourth circuit connected to said first terminal, to said first circuit and to said gate for interrupting the circuit path between said first circuit and said gate when said energy source provides energy of a first predetermined potential and for rendering the circuit path continuous when said energy source provides energy at a second predetermined potential less than said first predetermined potential to effect closure of said gate and initiation of said device by the discharge of said first energy device.

2. The initiating circuit of claim 1, wherein said gate comprises a silicon controlled rectifier.

3. The initiating circuit of claim 1, wherein said first energy storage device comprises a first capacitor.

4. The initiating circuit of claim 1, wherein said vibration responsive means is a tremble switch.

5. The initiating circuit of claim 1, wherein said second circuit comprises a delay time switch.

6. The initiating circuit of claim 1, wherein said second energy storage device comprises a second capacitor, and said circuit elements comprise a first transistor switching circuit and a second transistor switching circuit, said first transistor switching circuit biasing said second transistor switching circuit nonconductive when said severable current conductive means is intact, and said second transistor switching circuit made conductive by said first transistor switching circuit in response to the severance of said severance of said severable current conductive means, said second transistor switching circuit thereby discharging said second capacitor through said second transistor switching circuit to said gate.

7. The firing circuit of claim 6, wherein said severable current conductive means comprise a breakwire.

8. The firing circuit of claim 1, wherein said fourth circuit comprises a third transistor switching circuit and a fourth transistor switching circuit, said third transistor switching circuit operable in response to said first predetermined potential for biasing said fourth transistor switching circuit nonconductive, and operable in response to said second predetermined potential for biasing said fourth transistor switching circuit conductive, whereby said first energy storage means discharges through said fourth transistor switching means to said gate.

* * * * *